US007328666B2

(12) United States Patent
Tsumiyama et al.

(10) Patent No.: US 7,328,666 B2
(45) Date of Patent: Feb. 12, 2008

(54) SMALL WATERCRAFT

(75) Inventors: Yoshinori Tsumiyama, Miki (JP); Kunihiko Kamio, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/517,008

(22) Filed: Sep. 6, 2006

(65) Prior Publication Data

US 2007/0068434 A1 Mar. 29, 2007

(30) Foreign Application Priority Data

Sep. 9, 2005 (JP) ..... 2005-261925

(51) Int. Cl.
*B63B 35/73* (2006.01)

(52) U.S. Cl. ..... 114/55.53

(58) Field of Classification Search ..... 114/55.53; 296/76; 180/69.21

See application file for complete search history.

(56) References Cited

U.S. PATENT DOCUMENTS 2,090,473 A * 8/1937 Crabb ..... 217/60 C
3,236,551 A * 2/1966 Nash ..... 292/11
4,125,170 A * 11/1978 Botz ..... 180/69.21
4,644,891 A * 2/1987 Niina ..... 114/201 R

FOREIGN PATENT DOCUMENTS

JP 2000-025691 1/2000

* cited by examiner

*Primary Examiner*—Stephen Avila
(74) *Attorney, Agent, or Firm*—Alleman Hall McCoy Russell & Tuttle LLP

(57) ABSTRACT

A small watercraft equipped with a lock mechanism for an engine hood is disclosed. The watercraft includes a deck, an engine hood that is pivotably provided to the deck around a pivot shaft, and covers an engine room thereunder from above so as to open and close, and a lock mechanism for locking the hood in an open position. The mechanism includes one member attached to the hood, another member attached to the deck, and a stopping member. At least one of the one member and the another member is formed with a protruding portion that protrudes in the radial direction of the pivoting. The stopping member is attached to the other member, and the protruding portion engages with the stopping member when the engine hood reaches a predetermined open position so that the protruding portion stops the pivoting of the one member to lock the hood in the position.

8 Claims, 6 Drawing Sheets

SMALL WATERCRAFT

CROSS-REFERENCE TO RELATED APPLICATION

The present application claims priority from Japanese Patent Application No. 2005-261925 filed Sep. 9, 2005, which is hereby incorporated by reference in its entirety for all purposes.

TECHNICAL FIELD

The present invention relates to a lock mechanism of an engine hood of a small watercraft, more specifically, to a lock mechanism that is suitable for the engine hood of a sitting-type small watercraft.

BACKGROUND

A type of small watercraft, referred to as a personal watercraft (PWC), is of a sitting-type and may be designed for riding by one person by having an engine arranged in a slightly front portion forward from the center of a hull, and for operation suitable for aggressive races by having its center of gravity in the front portion.

In one example of such a sitting-type small watercraft, the engine is arranged in a space extending in front of a seat. An engine hood is provided above a deck so that it covers a deck opening above the engine so as to open and close.

The engine hood extends from a front end portion of the deck to a front end portion of the seat, and a steering handle is provided in a rear end portion of the engine hood. The steering handle is coupled with a steering nozzle of a water jet pump through a mechanical coupling mechanism.

The engine hood is rotatably supported by the deck so as to open and close at a front end portion thereof. The engine hood is configured so that it can be opened by lifting with the steering handle to the front.

As described above, the engine hood of the sitting-type small watercraft that is provided with the steering handle in the rear end portion thereof is relatively heavy to open and close. Therefore, a lock mechanism that locks the engine hood at a predetermined open position is necessary when the engine hood is opened to the position (for example, refer to Japanese Unexamined Patent Application No. 2000-25691).

One example of conventional lock mechanism is a stay type. This lock mechanism is provided with a stay that is pivotably supported by the deck at a lower end portion so that it can be accommodated under the engine hood. With this configuration, a user may manually lift the engine hood to open the hood and, then, the user may lift the stay by lifting a free end of the stay with one hand. A hook portion formed at this free end is hooked in a hole formed in a lower surface of the engine hood so that the engine hood can be locked in the open position.

Another example of a lock mechanism is a gas-damper type. This lock mechanism is to couple the engine hood and the deck with a gas damper. The engine hood can be locked to the open position by action of a gas damper (Japanese Unexamined Patent Application No. 2000-25691).

However, for the stay-type lock mechanism as mentioned above, in order to lock the engine hood in the open position, the user is required to operate the stay using one hand while holding the engine hood in the open position with the other hand. As mentioned above, since the steering handle is formed in the rear end portion of the engine hood, the engine hood is relatively heavy and, thus, it is burdensome to hold the engine hood in the open position with one hand.

On the other hand, for the gas-damper type lock mechanism, although it does not require such a user operation, the lock mechanism itself is costly.

DESCRIPTION OF THE INVENTION

The present invention is to address the above situations, and provides a small watercraft equipped with a lock mechanism in which a user can easily open an engine hood and lock the engine hood in an open position, and that is low in cost.

According to one aspect of the present invention, the small watercraft includes a deck having an engine hood that is pivotably provided to the deck around a first pivot shaft, and covers an engine room thereunder from above so as to open and close, and a lock mechanism for locking the engine hood in an open position. The lock mechanism may include an engine-hoodside member attached to the engine hood, a deck-side member attached to the deck, and a stopping member. At least one member of the engine-hood-side member and the deck-side member may be formed with a protruding portion that protrudes in the radial direction of the pivoting. The stopping member may be attached to the other member, and the protruding portion may engage with the stopping member when the engine hood reaches a predetermined open position so that the protruding portion stops the pivoting of the one member to lock the engine hood in the predetermined open position.

In one aspect, the configuration is to simply engage one of pivotable members (i.e., the engine-hood-side member or the deck-side member) and the stopping member. Thus, the engine hood of a sitting-type small watercraft may be locked in an open position even if a user does not carry out a special operation with his hand off the engine hood when the user opens the engine hood.

Preferably, the engine-hood-side member and the deck-side member may be coupled with each other so as to relatively pivot around the first pivot shaft as a center, and the protruding portion may be formed so as to protrude in a radially outward direction from a center of the first pivot shaft.

Preferably, the stopping member may be configured to engage with and disengage from the protruding portion by swinging in a plane that is substantially perpendicular to the first pivot shaft.

Preferably, the protruding portion may include an engaging convex portion formed in a convex shape, and the stopping member may include an engaging concave portion formed so as to oppose the engaging convex portion of the protruding portion.

Preferably, the stopping member may include a spring for biasing the engaging concave portion in a direction in which the engaging concave portion engages with the protruding portion.

Preferably, the spring may have an elastic coefficient such that an engaged state of the engaging concave portion and the protruding portion can be manually canceled.

Preferably, at least a portion of the stopping member may be fixed to one of the engine hood and the deck by a common fastener with the other member.

Preferably, the stopping member may include a swinging member that is swingable around a second pivot shaft that is substantially parallel with the first pivot shaft.

Preferably, the spring may be a leaf spring that is oriented such that a thickness direction thereof is along a plane substantially perpendicular to the first pivot shaft, and the engaging concave portion may be a bend portion formed in an intermediate portion of the leaf spring.

BRIEF DESCRIPTION OF THE DRAWINGS

The disclosure is illustrated by way of example and not by way of limitation in the figures of the accompanying drawings, in which the like reference numerals indicate similar elements and in which.

DETAILED DESCRIPTION

Hereinafter, a small watercraft according to the present invention will be described in detail referring to the appended drawings.

Figure 1:
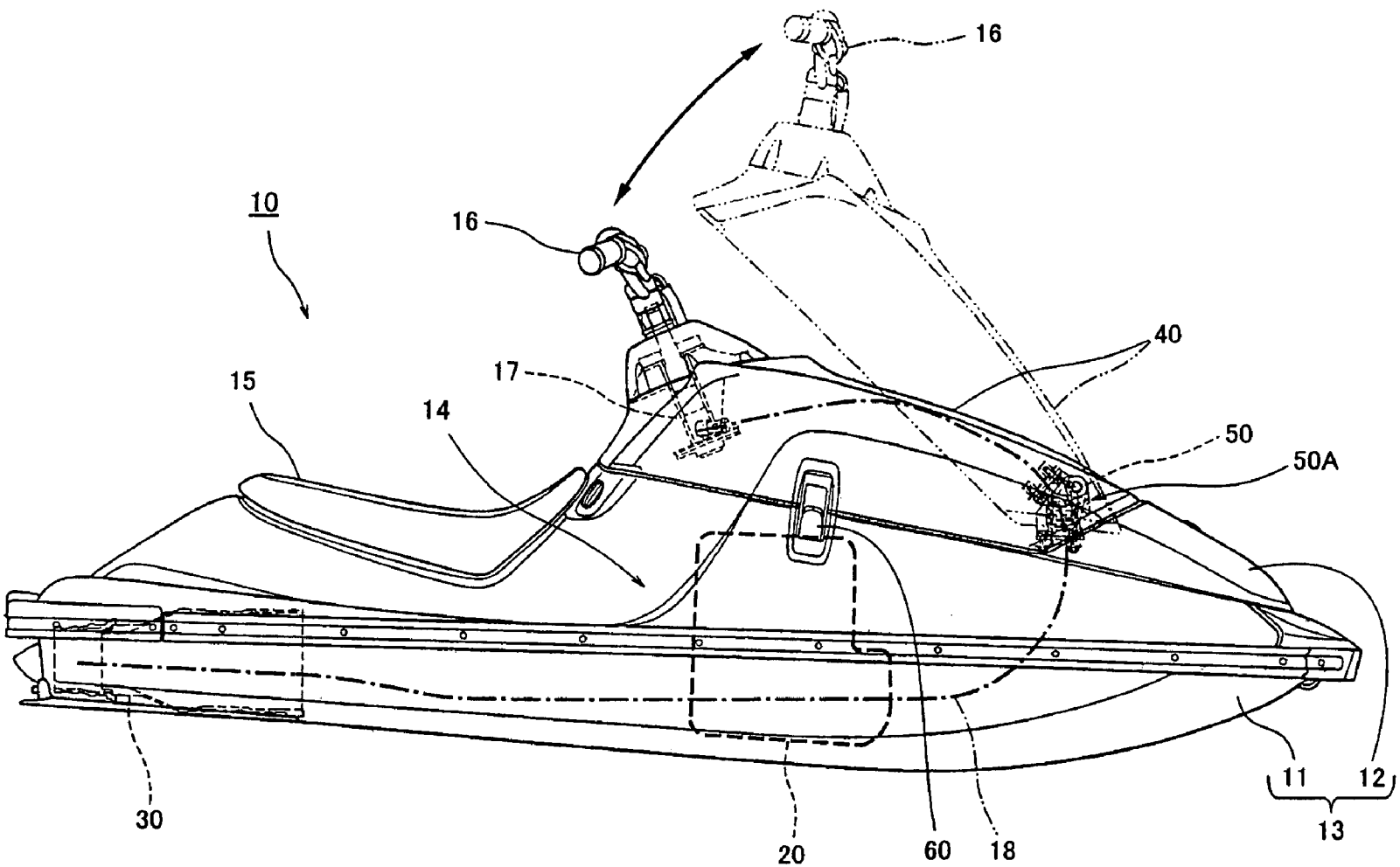
FIG. 1 is a right side view showing the entire configuration of a sitting-type small watercraft according to an embodiment of the present invention.
Figure 2:
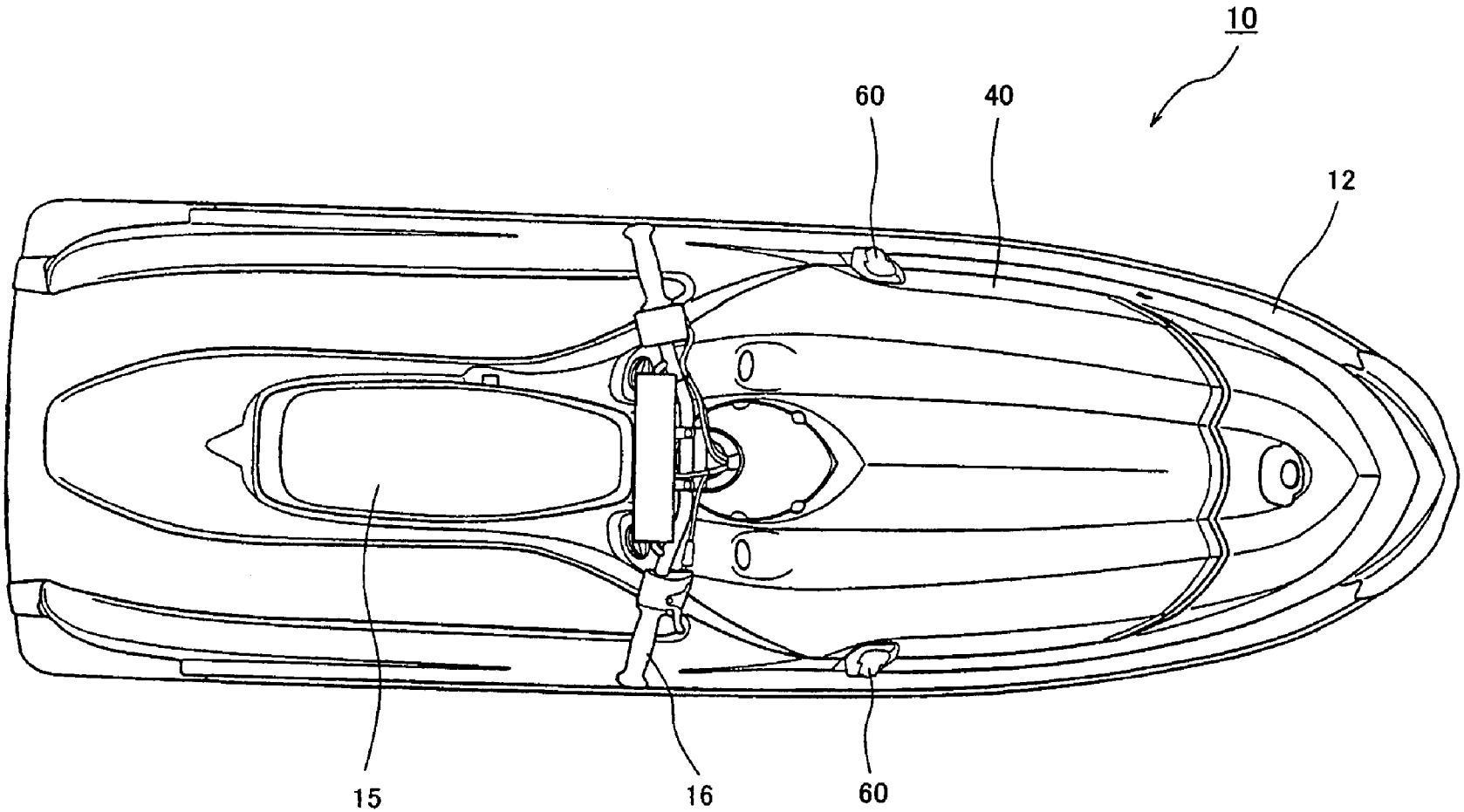
FIG. 2 is a plan view of the small watercraft shown in FIG. 1.

As shown in FIGS. 1 and 2, a small watercraft 10 according to one embodiment of the present invention is a sitting-type small watercraft (PWC) configured for riding by one person. A watercraft body 13 is constituted by a hull 11 and a deck 12 that covers an upper portion of the hull 11. An engine 20 is arranged in an engine room 14 formed slightly forward from the center of the watercraft body 13.

On the deck 12 and rearward of the engine 20, a seat 15 is provided, which is configured so that a user can sit, typically in a straddle position. In the sitting-type small watercraft, for example, the user is able to take various seating postures between such a seated posture, and a posture where the user stands up in a semi-crouching posture.

An upper surface of the deck 12, forward of the seat 15 is covered by an engine hood 40, and the engine room 14 is formed below thereunder. The engine hood 40 extends from a proximity to a front end of the seat 15 to a front end portion of the deck 12. A steering handle 16 is provided in a rear end portion of the engine hood 40. Further, as shown in FIG. 1, the engine hood 40 is pivoted on the deck 12 so as to open and close by a hinge mechanism 50 (shown with dashed lines) that is attached to a front end portion of the engine hood 40. As shown with two-point chain lines, the engine hood 40 is configured so that it can be opened by lifting with steering handle 16 to the front.

A steering column 17 (shown with dashed lines) of the steering handle 16 is attached with a relatively large angle (e.g., approximately 45 degrees) with respect to a radial direction of the pivoting of the engine hood 40 around a hinge shaft (in detail, a collar 53 in FIGS. 3, 4, 5A and 5B, for example) of the hinge mechanism 50, where the direction is, for example, a connecting line between the hinge shaft and a lower end of the steering column 40. That is, the hinge mechanism 50 rotatably supports the engine hood 40 so that the steering column 40 is inclined to the rear also by an angle of approximately 45 degrees when the engine hood 40 is closed.

A lower end portion of the steering column 17 extends inside the engine hood 40, and, typically, is coupled with one end of a push-pull cable 18 (shown with an one-point chain line). The other end of the push-pull cable 18 is coupled with a steering nozzle of a water jet pump 30 (shown with dashed lines) arranged in a rear end portion of the watercraft body 13, thereby allowing steering by the steering handle 16. Although it will not be particularly explained herein, it will be appreciated that a similar coupling between a throttle lever typically attached to the steering handle 16 and a throttle (valve) of the engine 20 may be possible.

Next, a lock mechanism 50A of the engine hood 40 according to the embodiment will be explained in detail. First, referring to FIG. 3, an engine-hood-side bracket 51 typically made of metal is attached to the engine hood 40. The engine-hood-side bracket 51 is substantially of a wide channel shape with four holes 511*a* formed in its web portion 511. The engine-hood-side bracket 51 is fixed to a deep recessed portion in front of the engine hood 40 (refer to FIG. 4) by bolts 513 (only one is illustrated) each of which is inserted in the hole 511*a*. Further, a hole 512*a* is formed in flange portions 512 on both sides of the engine-hood-side bracket 51, at respective positions symmetrical in the left-and-right direction.

Figure 3:
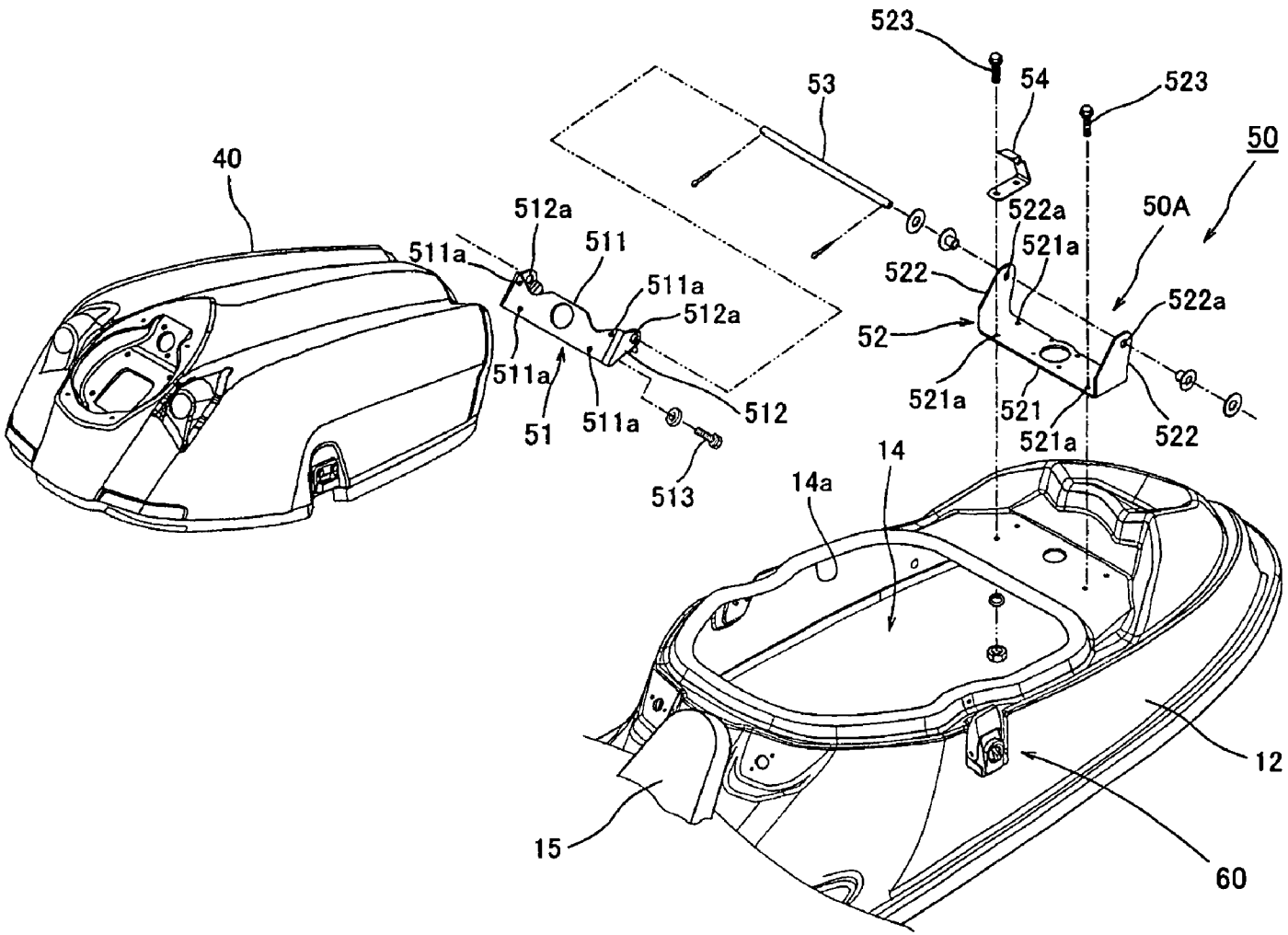
FIG. 3 is an exploded perspective view from the rear right, showing a hinge mechanism and its lock mechanism of an engine hood of the small watercraft shown in FIGS. 1 and 2.

In the meantime, in FIG. 3, the steering handle 16, and a cover (refer to FIG. 1) that covers a base portion of the steering handle 16 that attaches the steering handle 16 to the engine hood 40 are omitted from the engine hood 40 for ease of illustration.

Further, as mentioned above, the engine room 14 is located between the front end portion of the deck 12 and the proximity to the front end of the seat 15. An opening 14*a* is formed in a portion of the deck 12 above the engine room 14. The engine hood 40 is provided so as to be able to close the opening 14*a*.

A deck-side bracket 52 typically made of metal of a wide channel shape as well, is attached to the deck 12 in front of the opening 14*a*. The deck-side bracket 52 is fixed to the deck 12 by four bolts 523 (only two are illustrated), each of which is inserted into respective hole 521*a* (only three are illustrated) formed in a web portion 521 of the deck-side bracket 52. Further, a hole 522*a* is formed in flange portions 522 on both sides of the deck-side bracket 52, at respective positions symmetrical in the left-and-right direction.

Through the two holes 512*a* formed in the flange portions 512 on the both sides of the engine-hood-side bracket 51, and the two holes 522*a* formed in the flange portions 522 on the both sides of the deck-side bracket 52, a metal collar 53 of a pipe shape that forms the pivot shaft of the hinge mechanism 50 is inserted in the left-and-right direction and, thus, the engine-hood-side bracket 51 and the deck-side bracket 52 are supported by the collar 53 so that the brackets are relatively pivotable to each other.

A width of the engine-hood-side bracket 51 (that is, a dimension between the flange portions) is made slightly smaller than a width of the deck-side bracket 52. Thereby, the flange portions 512 on the both sides of the engine-hood-side bracket 51 are located inside the flange portions 522 on the both sides of the deck-side bracket 52.

Further, in this embodiment, the hinge mechanism 50 is provided with the lock mechanism 50A that locks the engine hood 40 in a predetermined position. Hereinafter, the lock mechanism 50A will be explained in detail. The lock mechanism 50A includes a stopping member that locks the engine hood 40 in the predetermined position, and a leaf spring 54 as the stopping member is fixed to the deck 12 through the deck-side bracket 52 by two common bolts 523 (only one is illustrated). In this embodiment, as shown in FIG. 3, only one leaf spring 54 is provided on the left side of the watercraft. This is for the purpose of assisting one-hand operation by a user, as will be described hereinafter, and it will be appreciated that a leaf spring may also be provided on both the right and left sides.

Figure 4:
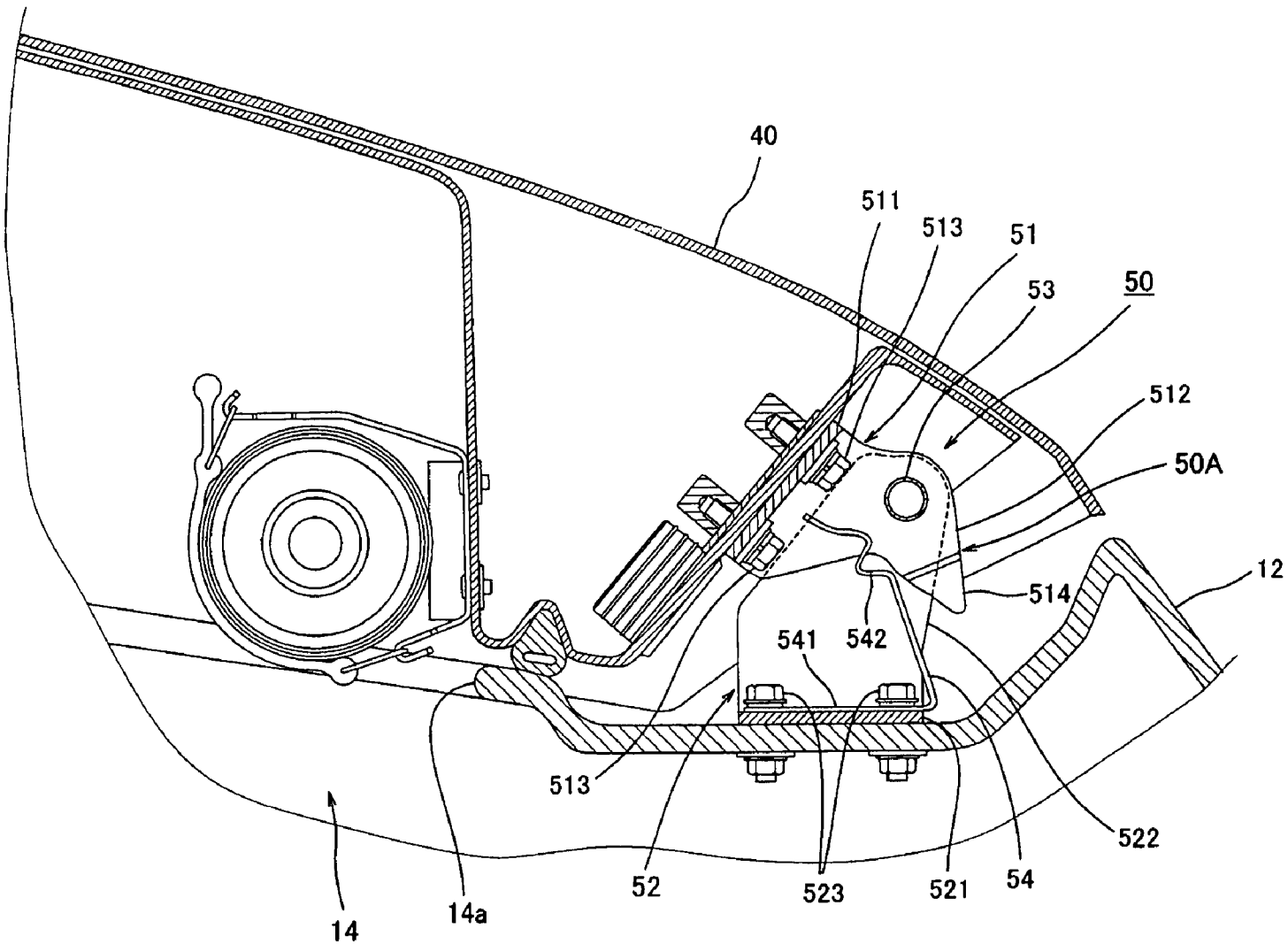
FIG. 4 is a right side cross-sectional view showing the hinge mechanism and its lock mechanism of the engine hood of the small watercraft shown in FIGS. 1 and 2.
Figure 5B:
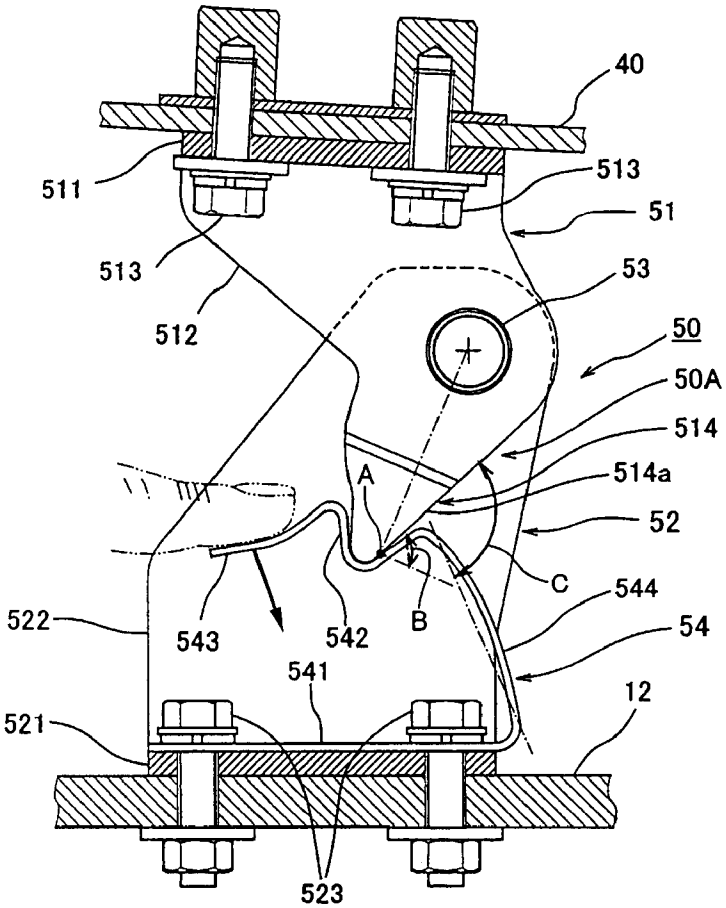
FIG. 5B is a right side cross-sectional view for explaining an operation of the lock mechanism of the engine hood shown in FIG. 4, showing a state (an open position) where the engine hood is opened and locked in the state.

As shown in FIG. 3, the leaf spring 54 typically is formed by bending a metal plate member, typically of a belt shape. In more detail, as shown in FIG. 4, the leaf spring 54 includes a bottom portion 541 placed along the top of web portion 521 of the deck-side bracket 52, and a front end portion of the bottom portion 541 is bent upward and slightly rearward to form a substantially straight extended portion 544 (FIG. 5B). A bend portion 542 as an engaging concave portion is formed in an intermediate portion of the extended portion 544 so that it is recessed upward and forward. That is, the leaf spring 54 extends in a direction substantially perpendicular to a shaft direction of the collar 53 as the pivot shaft.

Figure 5A:
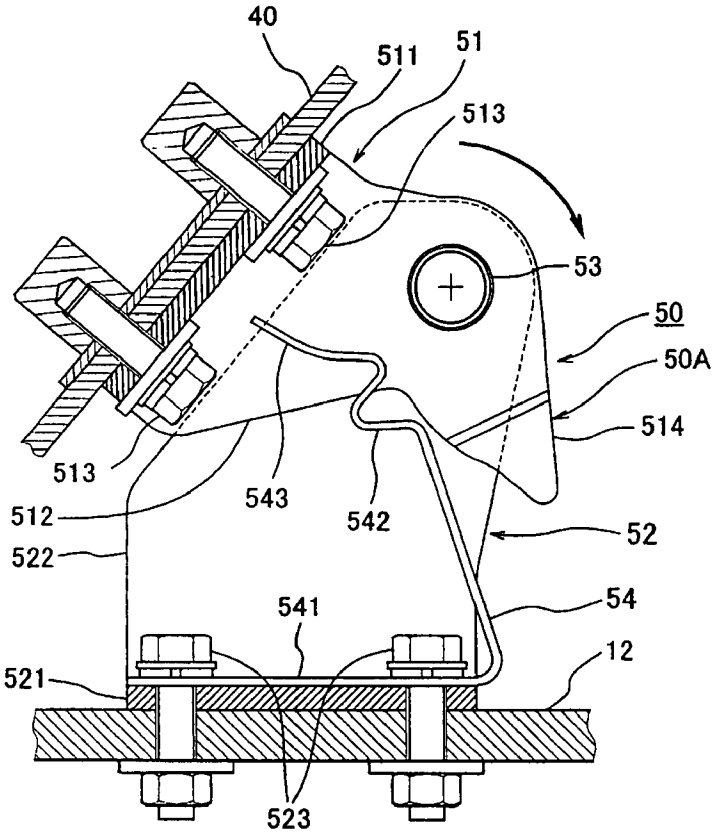
FIG. 5A is a right side cross-sectional view for explaining an operation of the lock mechanism of the engine hood shown in FIG. 4, showing a state (a closed position) where the engine hood is closed.

On the other hand, the engine-hood-side bracket is formed with a protruding portion 514 as the engaging convex portion that engages with the above-mentioned engaging concave portion, and holds the engine hood 40 in the predetermined open position. Explaining in full detail, as shown in FIG. 5A, the flange portion 512 of the engine-hood-side bracket 51 further extends beyond an inserted position of the collar 53, and a tip end portion thereof is formed to taper off so that it constitutes the protruding portion 514 as the engaging convex portion. When the engine hood 40 is in the closed position, this protruding portion (engaging convex portion) 514 is oriented forward and downward, and is in a position at which it does not interfere with the leaf spring 54.

Also referring to FIG. 3, the leaf spring 54 is located closer to the longitudinal center of the watercraft than the left-side flange portion 512 of the engine-hood-side bracket 51 (that is, in this embodiment, on the right side of the left-side flange portion 512). Thus, in FIG. 5A, the leaf spring 54 does not interfere with the flange portion 512 even if the leaf spring 54 is in an extended state.

However, the protruding portion (engaging convex portion) 514 formed in the tip end portion of the flange portion 512 is bent in a crank shape to the right (refer to FIG. 3) so that it aligns with a position of the leaf spring 54 in the left-and-right direction.

Thereby, when the engine hood 40 is opened as shown with an arrow, from the closed position of FIG. 5A, the protruding portion (engaging convex portion) 514 of the flange portion 512 pushes back and bends the leaf spring 54 so that it slides on the leaf spring 54 from the base end portion thereof, and, in due course, it fits in the bend portion (engaging concave portion) 542 to lock the engine hood 40 in the open position.

In this embodiment, the shape of the bend portion (engaging concave portion) 542 of the leaf spring 54, and the shape of the protruding portion (engaging convex portion) 514 of the flange portion 512 are configured so that it is difficult to disengage the engaging convex portion 514 from the engaging concave portion 542 even if the user tries to close the engine hood 40 with an ordinary force. That is, by this action the lock mechanism according to the embodiment realizes a self-lock. It will be appreciated that it may be configured so that the engaging convex portion 514 disengages from the engaging concave portion 542 when the user tries to close the engine hood 40 with some large force greater than the ordinary force.

The following factors make it difficult for the engaging convex portion 514 to disengage from the engaging concave portion 542. The factors are, for example, a reduced opening angle of the engaging concave portion 542 of the leaf spring 54, a reduced tip radius of the engaging concave portion 542, an increased engaging depth of the flange portion 512 with engaging convex portion 514, etc.

Further, a configuration that makes it difficult for the engaging convex portion 514 to disengage from the engaging concave portion 542 is shown in FIG. 5B. When a force is applied in a direction to close the engine hood 40 in the open position, a slope angle B of the engaging concave portion 542 may be made as close to a right angle as possible with respect to a tangent line of a rotation of the engaging convex portion 514 at a position A where the engaging convex portion 514 pushes the engaging concave portion 542.

Further, the closer to a right angle an angle C of the extended portion 544 is with respect to a pushing surface 514*a* where the engaging convex portion 514 pushes the engaging concave portion 542, the more difficult the extended portion 544 bends by a pushing force of the engaging convex portion 514, and thus the engaging convex portion 514 is more difficult to disengage from the engaging concave portion 542.

Due to the above configuration, when the user lifts the engine hood 40 from the state shown in FIG. 5A to the predetermined open position as shown in FIG. 5B, the engaging convex portion 514 engages with the engaging concave portion 542 so that the engaging convex portion 514 becomes difficult to disengage from the engaging concave portion 542, thereby locking the engine hood 40 in this open position. Since the self lock is achieved, the user is not required to do a special operation, that is, for example, to release one hand from the engine hood 40 or the steering handle 16, etc., when the user opens the engine hood.

In order to cancel the locked state of the lock mechanism 50 from this open position and to close the engine hood 40, the user slightly lifts the engine hood 40 with one hand, and then depresses the free end 543 of the leaf spring 54 with a finger of the other hand etc., as shown with two-point chain lines and an arrow in FIG. 5B. By this operation, the engaging convex portion 514 easily disengages from the engaging concave portion 542, and, thus, the engine hood 40 can be closed.

It is preferable that the leaf spring 54 has an elastic coefficient suitable for the necessity of depressing the free end 543 with a finger etc. (for example, approximately 3-15 kg, more preferably, approximately 5-7 kg, if converting into the depression force with a finger etc.). Further, for similar reasons, it is preferable that the free end 543 of the leaf spring 54 is of a length or size sufficient to place the finger thereon.

In this embodiment, as shown in FIG. 3, although the flange portions 512 on the both sides of the engine-hood-side bracket 51 are formed in the same shape nevertheless only one leaf spring 54 is provided, the flange portion on the side which does not have the leaf spring 54 may not be provided with the protruding portion 514 (FIG. 5A).

Further, in this embodiment, although the engaging concave portion 542 is provided to the leaf spring 54 and the engaging convex portion 541 is provided to the engine-hood-side bracket 51, the engaging concave portion 542 may be provided in the engine-hood-side bracket 51 and the engaging convex portion 541 may be provided in the leaf spring 54. Further, the leaf spring may be provided on the engine-hood side, and the protruding portion may be provided on the deck side.

Figure 6B:
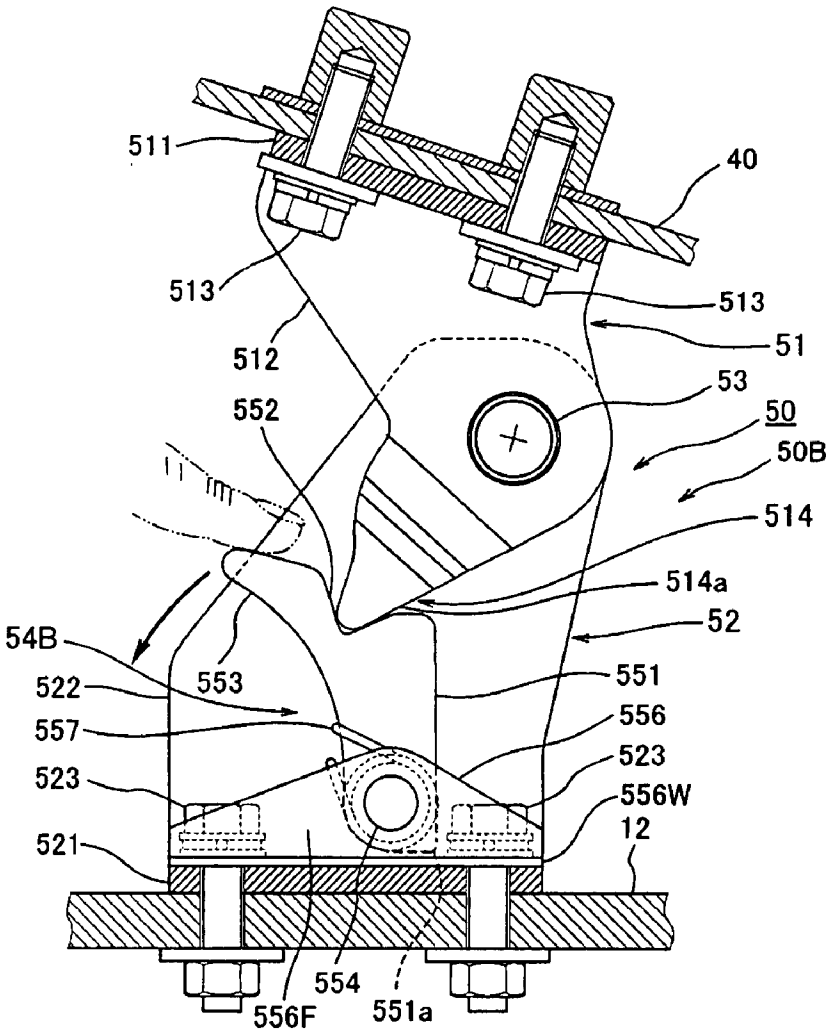
FIG. 6B is a right side cross-sectional view for explaining the configuration and operation of the lock mechanism of the engine hood according to the another embodiment, showing a state (an open position) where the engine hood is opened and locked in the state.
Figure 6A:
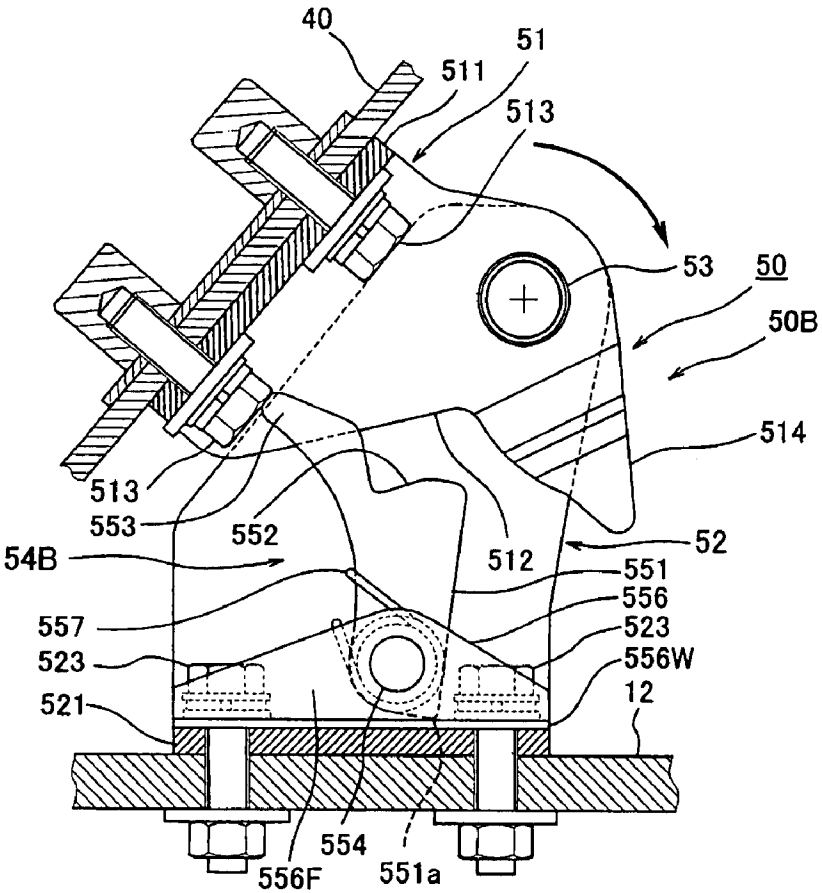
FIG. 6A is a right side cross-sectional view for explaining a configuration and operation of a lock mechanism of the engine hood according to another embodiment, showing a state (a closed position) where the engine hood is closed.

FIGS. 6A and 6B show a lock mechanism 50B of the engine hood 40 according to another embodiment. Although the lock mechanism 50B according to this embodiment is provided with the same engine-hood-side bracket 51 and the same deck-side bracket 52 as the previous embodiment, and instead the leaf spring 54, it includes a stopping member 54B that is different from the leaf spring 54. This stopping member 54B includes a swinging member 551, a torsion spring 557, and a base 556.

The base 556 is formed in a channel shape opened upward, and is arranged along the longitudinal direction of the watercraft body. The base 556 is fixed to the deck 12 by a web portion 556W thereof through the deck-side bracket 52 with two common bolts 523. A hole is formed in positions corresponding to flange portions 556F on the left and right of the base 556, respectively, and a pivot shaft 554 in the left-and-right direction is inserted through the holes.

A swinging member 551 is pivotably supported by the pivot shaft 554 between the flange portions 556F on the left and right. The swinging member 551 extends substantially upward from the pivot shaft 554, and an engaging concave portion 552 is formed in an intermediate position opposing the protruding portion 514 at a tip end of the engine-hood-side bracket 51. The engaging concave portion 552 is formed in a shape equivalent to the bend portion 542 shown in FIGS. 5A and 5B. Further, a free end portion 553 of the swinging member 551 has a length or size sufficient to place a finger etc. in order to accommodate the necessity of being depressed by a finger.

The swinging member 551 is biased in a direction in which the engaging concave portion 552 engages with the protruding portion (engaging convex portion) 514 of the engine-hood-side bracket 51, by the torsion spring 557 disposed between the flange portions 556F on the left and right sides. In the meantime, a stopper portion 551*a* is formed in a base portion of the swinging member 551, to interfere with an upper surface of the web portion 556W of the base 556 so that swinging of the swinging member 551 to the front (a swing in the clockwise direction in FIGS. 6A and 6B) is stopped at a predetermined angle. In this embodiment, the stopper portion 551*a* is a portion that protrudes in a radially outward direction from a center of the pivot shaft 554.

By this stopper portion 551*a*, when the engine hood 40 is in the closed position as shown in FIG. 6A, the swinging member 551 is in a state where it stopped at a slightly inclined angle to the front.

The lock mechanism SOB according to the embodiment has such a configuration, and when the engine hood 40 is opened as shown with an arrow from the closed position in FIG. 6A, the protruding portion 514 at the tip end of the flange portion 512 slides on the swinging member 551 from its base portion and pushes down the swinging member 551 to the rear, and, in due course, the protruding portion 514 fits in the engaging concave portion 552, thereby, achieving the self lock of the engine hood 40 in the open position. At this point, upon the engagement of the protruding portion 514 at the tip end and the engaging concave portion 552, they are configured so that they generate a strike sound. This strike sound is to notify the user that the engine hood 40 reaches to the open position, and is certainly locked.

For the purpose of generating this strike sound, it is preferable that the swinging member 551 may be a block shape with a large mass and great hardness, to some extent. For example, the swinging member 551 may be formed from an aluminum alloy, etc.

Also in this embodiment, since the engaging concave portion 552 of the swinging member 551 is formed basically in the same shape as the bend portion 542 of the leaf spring 54 in the previous embodiment (see FIGS. 5A and 5B), their difficulty of mutual disengagement is substantially the same.

In order to cancel the locked state of the lock mechanism 50B and to close the engine hood 40 from this open position, the user slightly lifts the engine hood 40 with one hand, and then depresses the free end portion 553 of the swinging member 551 with a finger of the other hand etc., as shown with two-point chain lines and an arrow in FIG. 6B. By this operation, the protruding portion 514 can easily disengage from the engaging concave portion 552 and, thus, the engine hood 40 can be closed.

It is preferable that the torsion spring 557 has an elastic coefficient suitable for the necessity of depressing the free end portion 553 with a finger, etc. For example, it may have an elastic coefficient equivalent to that which can resist against the depression force for the lock mechanism 50 shown in FIGS. 5A and 5B.

In the meantime, there is an advantage that the torsion spring 557 is easier to design than the leaf spring 54 so as to generate a desired force.

In this embodiment, although the engaging concave portion 552 is provided in the swinging member 551 and the engaging convex portion 514 is provided in the member on the side of the engine hood, the engaging concave portion 552 and the engaging convex portion 514 may be oppositely provided to the members instead. Further, the swinging member 551 may be provided on the engine-hood side, and the engaging convex portion 514 may be provided on the deck side.

In the meantime, the sitting-type small watercraft such as that described in this embodiment has the following advantages with respect to a standing-type small watercraft.

(1) Since the engine hood 40 to which the steering handle 16 is provided is fastened to the deck 12 by latch mechanisms 60 (see FIGS. 1-3) arranged on both side edges of the engine hood 40, the user may be able to lay his/her body on the steering handle 16 during operation, stabilizing an operating posture.

(2) Since the engine hood 40 and the steering column 17 are covered with a single cover (i.e., the engine hood 40), and since one hinge (i.e., the lock mechanism 50) is sufficient, it can be achieved with fewer parts and lower cost.

Although the present disclosure includes specific embodiments, specific embodiments are not to be considered in a limiting sense, because numerous variations are possible. The subject matter of the present disclosure includes all novel and non obvious combinations and sub combinations of the various elements, features, functions, and and/or properties disclosed herein. The following claims particularly point out certain combinations and sub combinations regarded as novel and non obvious. These claims may refer to "an" element or "a first" element or the equivalent thereof. Such claims should be understood to include incorporation of one or more such elements and neither requiring, nor excluding two or more such elements. Other combinations and sub combinations of features, functions and elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A small watercraft including a deck, comprising:

an engine hood that is pivotably provided to the deck around a first pivot shaft, and covers an engine room thereunder from above so as to open and close; and a lock mechanism for locking the engine hood in an open position, wherein the lock mechanism includes an engine-hood-side member attached to the engine hood, a deck-side member attached to the deckt, and wherein the lock mechanism further includes a stopping member;

wherein at least one member of the engine-hood-side member and the deck-side member is formed with a protruding portion that protrudes in the radial direction of the pivoting;

wherein the stopping member is attached to the other member, and the protruding portion engages with the stopping member when the engine hood reaches a predetermined open position so that the protruding portion stops the pivoting of the one member to lock the engine hood in the predetermined open position;

wherein the engine-hood-side member and the deck-side member are coupled with each other so as to relatively pivot around the first pivot shaft as a center; and wherein the protruding portion is formed so as to protrude in a radially outward direction from a center of the first pivot shaft.

2. The small watercraft of claim 1, wherein the stopping member is configured to engage with and disengage from the protruding portion by swinging in a plane that is substantially perpendicular to the first pivot shaft.

3. The small watercraft of claim 2, wherein the protruding portion includes an engaging convex portion formed in a convex shape, and the stopping member includes an engaging concave portion formed so as to oppose the engaging convex portion of the protruding portion.

4. The small watercraft of claim 3, wherein the stopping member includes a spring for biasing the engaging concave portion in a direction in which the engaging concave portion engages with the protruding portion.

5. The small watercraft of claim 4, wherein the spring has an elastic coefficient such that an engaged state of the engaging concave portion and the protruding portion can be manually canceled.

6. The small watercraft of claim 1, wherein at least a portion of the stopping member is fixed to one of the engine hood and the deck by a common fastener with the other member.

7. The small watercraft of claim 1, wherein the stopping member includes a swinging member that is swingable around a second pivot shaft that is substantially parallel with the first pivot shaft.

8. The small watercraft of claim 4, wherein the spring is a leaf spring that is oriented such that a thickness direction thereof is along a plane substantially perpendicular to the first pivot shaft, and the engaging concave portion is a bend portion formed in an intermediate portion of the leaf spring.

* * * * *